US012736216B2

(12) United States Patent
Skovbo

(10) Patent No.: US 12,736,216 B2
(45) Date of Patent: Sep. 15, 2026

(54) BURNER FOR LIQUID FUEL AND METHOD FOR OPERATING SUCH BURNER

(71) Applicant: Aduro A/S, Viby J (DK)

(72) Inventor: Christian Skovbo, Viby J (DK)

(73) Assignee: ADURO A/S, Viby J (DK)

( * ) Notice: Subject to any disclaimer, the term of this patent is extended or adjusted under 35 U.S.C. 154(b) by 342 days.

(21) Appl. No.: 18/263,398

(22) PCT Filed: Jan. 28, 2022

(86) PCT No.: PCT/DK2022/050014
§ 371 (c)(1),
(2) Date: Jul. 28, 2023

(87) PCT Pub. No.: WO2022/161586
PCT Pub. Date: Aug. 4, 2022

(65) Prior Publication Data

US 2024/0085017 A1 Mar. 14, 2024

(30) Foreign Application Priority Data

Jan. 29, 2021 (DK) ..... PA 2021 00104
Dec. 16, 2021 (DK) ..... PA 2021 01213

(51) Int. Cl.
*F23D 5/04* (2006.01)
*F23D 5/16* (2006.01)
*F23K 5/16* (2006.01)

(52) U.S. Cl.
CPC ..... *F23D 5/04* (2013.01); *F23D 5/16* (2013.01); *F23K 5/16* (2013.01)

(58) Field of Classification Search
CPC ..... F23D 5/04; F23D 2209/00; F23D 2900/31022; F23D 5/16; F23D 5/18;
(Continued)

(56) References Cited

U.S. PATENT DOCUMENTS 2,258,043 A * 10/1941 Brace ..... F23D 3/40 431/74
2,582,900 A * 1/1952 Benedict ..... B61D 27/0063 431/39

(Continued)

FOREIGN PATENT DOCUMENTS

EP 2098786 A1 9/2009
EP 3211304 A1 * 8/2017 ..... F23D 5/02

(Continued)

OTHER PUBLICATIONS

International Search Report mailed on Jul. 21, 2022, in connection with corresponding International Application No. PCT/DK2022/050014 (5 pp., including machine-generated English translation).

*Primary Examiner* — Craig Kim
(74) *Attorney, Agent, or Firm* — McCormick, Paulding & Huber PLLC

(57) ABSTRACT

The disclosure relates to a burner having a container for storing liquid fuel, a fuel inlet for filling liquid fuel into the container, and a fire outlet for fire from burning liquid fuel to leave the burner. The fire outlet may function as fuel inlet or a separate fuel inlet is provided. The burner includes a stopping mechanism and an actuator for controlling the stopping mechanism. The stopping mechanism is displaced by the actuator towards a first position, when the temperature of the actuator is changed from a relatively high temperature to a relatively low temperature. The stopping mechanism is displaced by the actuator towards the second position, when the temperature of the actuator is changed from a relatively low temperature to a relatively high temperature. The disclosure also relates to a method of operating such a burner and a funnel for a burner.

13 Claims, 7 Drawing Sheets

(58) Field of Classification Search
CPC ..... F23D 11/44; F23D 14/46; F23D 2202/00; F23N 5/04; F23N 2235/06; F23N 2223/24
See application file for complete search history.

(56) References Cited

U.S. PATENT DOCUMENTS 2,585,431 A * 2/1952 Breese ..... F23D 5/04 137/98
2,688,999 A * 9/1954 Van Tubergen ..... F23D 5/18 431/65
2,693,913 A * 11/1954 Antl ..... F23D 5/18 431/62
6,041,770 A * 3/2000 Erickson ..... F23N 3/047 126/285 R
7,325,541 B2 * 2/2008 Marcakis ..... F24B 5/023 126/285 R
9,228,739 B2 * 1/2016 Barudi ..... F23D 5/04
9,267,681 B2 * 2/2016 Barudi ..... F23K 5/147
12,359,805 B1 * 7/2025 Vainberg ..... F23D 14/46
2006/0134575 A1 * 6/2006 Backes ..... F23D 5/04 431/344

FOREIGN PATENT DOCUMENTS

FR 2956186 A1 * 8/2011 ..... F23D 5/14
GB 2243310 A 10/1991
GB 2555760 A * 5/2018 ..... F23K 5/02
JP 2021060145 A * 4/2021
WO 2009/049047 A1 4/2009
WO WO-2012000562 A1 * 1/2012 ..... F23D 5/14
WO WO-2012000563 A1 * 1/2012 ..... F24C 5/00
WO WO-2017201631 A1 * 11/2017 ..... F24C 5/04
WO WO-2022161586 A1 * 8/2022 ..... F23N 5/247

* cited by examiner

BURNER FOR LIQUID FUEL AND METHOD FOR OPERATING SUCH BURNER

CROSS-REFERENCE TO RELATED APPLICATIONS

This application is a National Stage application of International Patent Application No. PCT/DK2022/050014, filed on Jan. 28, 2022, which claims priority to Danish Patent Applications No. PA 2021 00104, filed on Jan. 29, 2021, and No. PA 2021 01213, filed on Dec. 16, 2021, each of which is hereby incorporated by reference in its entirety.

TECHNICAL FIELD

The invention relates to a burner for burning liquid fuel, the burner comprising a container for storing the liquid fuel and a fire outlet for fire from burning liquid fuel to leave the burner and possibly a fuel inlet for filling liquid fuel into the fuel inlet and into the container. The burner is for liquid fuel, such as bioethanol, used as an indoor or outdoor fireplace. The invention also relates to a gauge and a funnel for such burner.

BACKGROUND

Burners for liquid fuel are known to have a fuel inlet, which may be closed and opened by a user of the burner, possibly by a plug pushed into the fuel inlet, when fuel is not to be filled into the fuel container, and the plug being pulled from the fuel inlet, when liquid fuel is to be filled into the fuel container. Furthermore, a displaceable lid may be provided for covering the fire outlet. The lid covers the fuel inlet and a possible plug of the fuel inlet, when the lid is not covering the fire outlet, and vice versa. In the alternative, liquid fuel may be filled into the burner via the fire outlet, but if the burner is too hot it is very dangerous to fill the liquid fuel into the burner.

Opening and closing the fuel inlet, if provided, by pulling the plug from the fuel inlet and pushing the plug into the fuel inlet, respectively, and displacement of the fire outlet lid, if provided, to cover or allow fire from the fire outlet, is performed manually by a user of the burner.

EP 2,098,786 A1 discloses a storage container for a liquid fuel. A filling opening is provided adjacent to an adjustable cover element for filling the liquid fuel into the container. The adjustable cover element can be adjusted between a position that closes the storage container upwards in the area of the combustion zone, and a position that opens the storage container upwards in the area of the combustion zone.

Such a cover element allows a safe extinguishing of the flame after the end of use of the firing device and prevents unwanted evaporation of the liquid fuel stored in the storage container, when the firing device is not in use. The cover element enables the storage container to be sealed off at the top in the area of the combustion zone, so that when the combustion device is not in use, no escape of gaseous volatile liquid fuel is to be feared. Adjustment of the cover is performed manually.

An object of the present invention may be to increase safety of operating and using burners for liquid fuel, such as bioethanol, used as an indoor or outdoor fireplace.

SUMMARY

The object of the invention is obtained by a burner also comprising a stopping means for not allowing, preferably for preventing, filling of liquid fuel through the opening and into the container of the burner, where the burner comprises an actuator (6) for displacing the stopping means between a first position and a second position, and vice versa, and where the actuator (6) is positioned in part of the burner being heated by fire from burning liquid fuel, where the actuator (6) is provided in a position, in relation to the fire outlet (2), resulting in the actuator (6) changing temperature depending on a temperature of the burner within the vicinity of the opening for filling liquid fuel into the container of the burner, where change of the temperature of the actuator (6), because of change of temperature of part of the burner being heated by fire from burning liquid fuel, results in change of a geometrical shape of the actuator (6), and the actuator (6) and the stopping means being mutually connected for the actuator displacing the stopping means when a change of geometrical shape of the actuator occurs, where change of the geometrical shape of the actuator (6) results in displacement of the stopping means, via the connection, towards the first position or towards the second position, and where the stopping means is displaced towards the first position, when the temperature of the actuator (6) is changed from a high temperature to a low temperature, and in which first position the stopping means allowing liquid fuel to be filled into the container of the burner, and where the stopping means is displaced towards the second position, when the temperature of the actuator (6) is changed from a low temperature to a high temperature, and in which second position the stopping means not allowing liquid fuel being filled into the container of the burner.

A stopping means for stopping, preferably for preventing, a user from filling liquid fuel into the burner, and where displacement of the stopping means is provided by an actuator, which itself is displaced based upon the temperature of the actuator, has the advantage that not the user, but the actuator, controls whether liquid fuel can be filled into the burner or not. A risk of filling liquid fuel into the burner, when the burner is too hot for safely filling liquid fuel into the burner, is avoided. A user's possible negligence to the temperature of the burner, when filling liquid fuel into the burner, is not a problem.

According to a preferred embodiment of a burner according to the invention, the actuator is a bimetal spiral coil, and where the stopping means is mounted on the spiral coil, and where the stopping means displaces together with the bimetal spiral coil, when the bimetal spiral coil is mounted on the burner and when the bimetal spiral coil expands or contracts in dependence of a temperature change of the bimetal coil, due to a temperature change of the part of the burner.

The actuator being a spiral coil made from a bimetal material has the advantage, that the actuator is mechanical with no electronics provided, providing a reliable actuator, which is not prone to false operation, if perhaps liquid fuel is spilled, or temperatures are excessive or other parameters, which may influence operation of electronic actuators.

According to an alternative embodiment of a burner according to the invention, the actuator is a cylinder with a piston, and where the stopping means is mounted on one of either the cylinder or the piston, and where the stopping means displaces together with the cylinder or the piston, when at least the cylinder is mounted on the burner and when the cylinder or the piston displaces in dependence of a temperature change of a fluid in the cylinder, due to a temperature change of the part of the burner.

The actuator being a cylinder and piston also has the advantage, that the actuator is mechanical with no electronics provided, providing a reliable actuator, which is not prone to false operation, if perhaps liquid fuel is spilled, or temperatures are excessive or other parameters, which may influence operation of electronic actuators.

According to a possible embodiment of a burner according to the invention, the stopping means is a visual indication of a gauge, and where the fire outlet is within a limited distance from the gauge, the limited distance being of a magnitude resulting in part of the burner in the vicinity of the gauge being heated by fire from burning liquid fuel, the gauge having the actuator mutually connected with a dial with the visual indication, where the visual indication is divided between at least a first section of the dial indicating that the part of the burner is cold enough to safely fill liquid fuel through the opening, and a second section of the dial indicating that the part of the burner is too hot to safely fill liquid fuel through the opening, the first section of the dial indicating by the visual indication a relatively low temperature of the part of the burner, the second section indicating by the visual indication a relatively high temperature of the part of the burner, the gauge comprising an indicator capable of displacing between one position within the first section and another position within the second section, and where change of the geometrical shape of the actuator results in displacement of the indicator towards the one position or towards the other position, and where the indicator is displaced towards the one position, when the temperature of the actuator is changed from a high temperature to a low temperature, and in which one position the indicator is visible within the one section of the dial indicating liquid fuel is safe to fill into the fire outlet, and where the indicator is displaced towards the other position, when the temperature of the actuator is changed from a low temperature to a high temperature, and in which other position the indicator is visible within the other section of the dial indicating liquid fuel is unsafe to fill into the fire outlet.

A gauge to indicate whether the burner is too hot to safely fill liquid fuel into the burner limits the risk of a user doing so. If the gauge is placed correctly on part of the burner, where the burner is heated the most, the indication by the gauge will be optimal. Even filling liquid fuel into the fire outlet, instead of into a separate fuel inlet, is possible, by mounting the indicator at a selected part of the burner close to the fire outlet.

According to a possible embodiment of a gauge according to the invention, the indicator, when being within the second section of the dial, extends outside part of a perimeter of the gauge, said part of the perimeter of the gauge intended for being in immediate vicinity of the fire outlet, when the gauge is mounted on the burner, so that at least part of the indicator extends into at least part of an immediate exterior of the gauge.

The indicator extending outside part of the perimeter of the gauge has the advantage that the indicator may be used both for visually indicating to a user, what the temperature of the burner is, and also physically possibly obstructing filling of liquid fuel into the burner. The latter advantage is obtained if the gauge is mounted on the burner so that the part of the perimeter of the gauge is in immediate vicinity of the fire outlet.

According to an embodiment of the invention the opening for filling liquid fuel into a container of the burner is the fire outlet also functioning as the fuel inlet.

According to another embedment of the invention, the stopping means is a closure for an opening of a fuel inlet for filling liquid fuel into a container of the burner, the fuel inlet being separate from the fire outlet, and the fuel inlet being positioned in distance from the fire outlet, the closure capable of being displaced between a first position where the opening of the separate fuel inlet is not covered by the closure, allowing liquid fuel to be filled into the opening and into the container of the burner, and a second position where the opening of the separate fuel inlet is covered by the closure, not allowing liquid fuel from being filled into the opening and into the container of the burner.

A possible embodiment of the burner according to the invention is characterised in that, the burner comprising a lid capable of covering and not covering the fuel inlet and also capable of covering and not covering the fire outlet, thereby allowing or preventing liquid fuel to be filled into the fuel inlet and allowing or preventing fire from burning liquid fuel to leave the outlet of the burner, the lid being displaceable between a first position, where the fuel inlet is not covered by the lid and where the fire outlet is covered by the lid, allowing fuel to be filled into the fuel inlet and preventing fire from burning liquid fuel to leave the fire outlet, and a second position, where the fuel inlet is covered by the lid and where the fire outlet is covered by the lid, preventing fuel to be filled into the fuel inlet and preventing fire from burning liquid fuel to leave the fire outlet, and a third position, where fuel inlet is covered by the lid and where the fire outlet is not covered by the lid, preventing fuel to be filled into the fuel inlet and allowing fire from burning liquid fuel to leave the fire outlet.

An additional lid, additional to the closure and operated manually by a user of the burner, provides a safety means additional to the safety means of the closure, for possibly preventing liquid fuel to be burned at the fuel inlet, when fire from burning liquid fuel is leaving the fire outlet. The lid has the advantage of the lid covering the fuel inlet, when fire from burning liquid is leaving the fire outlet, and the advantage of the lid covering the fire outlet, when liquid fuel is to be filled into the fuel inlet.

In the embodiment, where the burner comprises both a closure and a lid, the closure is capable of being in the first position, not covering the fuel inlet, at the same time as the lid is in the second position or in the third position, covering the fuel inlet, and where the closure is capable of being in the second position, covering the fuel inlet, at the same time as the lid is in the first position, not covering the fuel inlet.

The invention has the advantage, that whether the fuel inlet is open or not is established by the closure, operated automatically by the actuator, depending on the temperature of the actuator, and is established independently of whether the lid, displaced manually by selection of a user of the burner, is displaced to cover the fuel inlet or not.

An even preferred embodiment of the invention is characterised in that, the outer end of the spiral coil is provided with a stop extending into a groove in the top cover of the burner, said groove being a circumferential path for the stop, the groove extending along a distance and having two ends opposite each other, and the stop is in abutment with one end of the groove, when the spiral coil is spiraled fully inwards, and where the stop is in abutment with another end of the groove, when the spiral coil is spiraled fully outwards, the stop thereby limiting spiralling of the spiral coil between a fully inwards spiralling and a fully outwards spiralling of the spiral coil, and thereby limiting displacement of the closure between the first position and the second position of the closure.

A stop limiting spiralling of the spiral coil between a fully inwards spiralling and a fully outwards spiralling of the spiral coil has the advantage, that the first position and the second position of the closure are fixed positions. The closure has a first position where the fuel inlet is fully open, and a second position where the fuel inlet is fully covered by the closure. The closure cannot be displaced to positions outside the first position and the second position, but the closure may be displaced to intermediate positions between the first position and the second position, and where the fuel inlet is partly open or partly covered by the closure.

A possible embodiment according to the burner of the invention is characterised in that, a switch mechanism, possibly a spring switch mechanism, is provided between the actuator and the closure, the switch mechanism capable of switching the closure, when operated by the actuator, from the first position, where the fuel inlet is fully open, to the second position, where the fuel inlet is fully covered by the closure, and vice versa, and the switch mechanism preventing the closure from being positioned in any intermediate positions, apart from when passing from the first position to the second position, and vice versa, the intermediate positions being between the first position and the second position, where the fuel inlet is either partly open or partly covered by the closure A switch mechanism providing a displacement of the closure between the first position and the second position, and preventing the closure from being positioned in intermediate positions between the first position and the second position, has the advantage that the fuel inlet is either fully open or fully covered by the closure. The switch mechanism prevents the fuel inlet to be partly open or partly covered by the closure. A user cannot fill liquid fuel into a partly open fuel inlet or a partly covered by the closure fuel inlet, only into a fully open fuel inlet.

Preferably, the high temperature is between 30 degrees Celsius and 80 degrees Celsius.

The object of the invention may also be obtained by a method for operating a closure of a burner for a liquid fuel, the burner comprising a container for storing the liquid fuel and a fuel inlet for filling liquid fuel into the container, and the burner comprising a fire outlet for burning liquid fuel to leave the burner, wherein the burner comprises a closure for opening and closing a fuel inlet for liquid fuel to be filled into the container, by a user filling liquid fuel from a container such as a bottle, not being part of the burner, into the container being part of the burner, where the closure is displaceable between a first position of the closure, where the fuel inlet is open to the exterior of the burner, and a second position of the closure, where the fuel inlet is covered by the closure and is to the exterior of the burner, wherein the closure is capable of being operated by an actuator, via a mechanical connection between the actuator and the closure, the actuator capable of displacing the closure between the first position and the second position of the closure, the actuator displacing the closure towards the first position, when a temperature of the actuator is below a selected threshold temperature, and the actuator displacing the closure towards the second position, when a temperature of the actuator is above a selected threshold temperature.

A burner with an actuator displacing the closure in dependence of the temperature of the actuator results in the closure closing the fuel inlet, preventing liquid fuel to be filled into the fuel inlet, when the temperature of the fuel inlet is above a threshold temperature. Thereby, the closure prevents liquid fuel to be filled from a bottle into the fuel inlet and into the container of the burner, when the temperature at the inlet is above a certain threshold temperature, thus avoiding liquid fuel to be burned at the fuel inlet and possibly in the bottle, resulting in the user possibly being burned and injured. The closure constitutes a safety means operating automatically to close the fuel inlet.

The object of the invention may also be obtained by a funnel for filling liquid fuel into a fire outlet of a burner for burning liquid fuel, the funnel having an inlet and an outlet for the liquid fuel, the outlet being provided in an oblong shape of the funnel, said oblong funnel outlet intended for extending horizontally along a longitudinal extension of a fire outlet of a burner when the funnel is placed on, or near, the burner and when liquid fuel is filled into the fire outlet of the burner via the funnel inlet and further via the funnel outlet in the oblong shape into the fire longitudinal extension of the fire outlet.

A funnel developed especially for filling liquid fuel into a fire outlet of a burner has the advantage that an individual inlet for filling liquid fuel into the burner may be omitted, and that liquid fuel is filled directly into the fire outlet, without liquid fuel accidently being spilled outside the fire outlet, thereby not risking liquid fuel being wasted or staining, e.g., a table on which, or a carpet above which, the burner is situated during use.

According to a preferred embodiment of the funnel according to the invention, the funnel outlet has an enlarged opening in at least one end of the oblong shape, the enlarged opening intended for facing a part of the longitudinal extension of the fire outlet of the burner, and which part of the fire outlet the oblong shape is not extending along.

A funnel developed especially for filling liquid fuel into a fire outlet of a burner and with an enlarged opening facing a longitudinal extension of the fire outlet, into which the liquid fuel is filled, but which part the funnel outlet is not directly situated above, has the advantage of the entire longitudinal extension of the fire outlet, and not only directly below the funnel, is filled with liquid fuel, ensuring an even distribution of liquid fuel along the entire extension immediately after having filled the liquid fuel into the burner.

According to a still preferred embodiment of the funnel according to the invention, the funnel has a bottom surface or other support intended for being positioned on an upper surface of a burner, and the oblong shape intended for extending along part of a longitudinal extension of a fire outlet of the burner when the bottom surface or other support of the funnel is positioned on the upper surface of the burner and liquid fuel is filled into the container of the burner, via the funnel inlet and further via the funnel outlet and even further via the fire outlet of the burner.

The object may especially be obtained by a burner with a gauge according to the invention and intended for being filled with liquid fuel by use of a funnel according to the invention, where a perimeter of the gauge is in immediate vicinity of part of a longitudinal extension of the fire outlet, and where the indicator, when being within the second section of the dial, extends outside a perimeter of the gauge, so that at the indicator extends into an immediate exterior of the gauge, and where an oblong shape of the funnel is prevented from extending horizontally along part of a longitudinal extension of the fire outlet of the burner, when the indicator extends outside the perimeter of the gauge, so that at least part of the longitudinal extension of the fire outlet is covered by the indicator.

A burner both having a gauge according to the invention and being filled with liquid fuel by using a funnel according to the invention has the advantage that both safety and ease of filling liquid fuel into the burner are optimised. A user is advised visually, in a safe and easy manner, of whether the burner is cold enough, or too hot, to safely fill liquid fuel into the burner and a user is also provided with a funnel to fill liquid fuel into the burner, even into the fire outlet, in a safe and easy manner, contrary to using a traditional funnel.

The object of the invention may also be obtained by a burner for burning liquid fuel, the burner comprising a container for storing the liquid fuel and a fire outlet for fire from burning liquid fuel to leave the burner, where the burner comprises an actuator for displacing the indicator between one position and the other position, and vice versa, and where the actuator is positioned in part of the burner being heated by fire from burning liquid fuel, where the actuator is provided in a position, in relation to the fire outlet, resulting in the actuator changing temperature depending on a temperature of the burner within the vicinity of the fire outlet, where change of the temperature of the actuator, because of change of temperature of part of the burner being heated by fire from burning liquid fuel, results in change of a geometrical shape of the actuator, and where change of the geometrical shape of the actuator results in displacement of the indicator towards the one position or towards the other position, and where the indicator is displaced towards the one position, when the temperature of the actuator is changed from a high temperature to a low temperature, and in which first position the indicator is visible within the one section of the dial indicating liquid fuel is safe to fill into the fire outlet, and where the indicator is displaced towards the other position, when the temperature of the actuator is changed from a low temperature to a high temperature, and in which second position the indicator is visible within the other section of the dial indicating liquid fuel is unsafe to fill into the fire outlet.

The object of the invention may also be obtained by a method for operating a closure of a burner for a liquid fuel, the burner comprising a fuel inlet for filling liquid fuel into the container, and the burner comprising a fire outlet for burning liquid fuel to leave the burner, the method comprising the following steps:

a user operating a lid for covering or not covering a fuel inlet for liquid fuel to be filled into the container, or the user operating the lid for covering or not covering a fire outlet for burning liquid fuel to leave the burner, where the lid is displaced to a first position of the lid, when the fuel inlet is to be not covered by the lid and is to be open to the exterior of the burner, and when the fire outlet is to be covered by the lid and is to be covered by the closure to the exterior of the burner, where the lid is displaced to a second position of the lid, when the fuel inlet is to be covered by the lid and is to be covered by the closure to the exterior of the burner, and when the fire outlet is to be covered by the lid and is to be covered by the closure to the exterior of the burner where the lid is displaced to a third position of the lid, when the fuel inlet is to be covered by the lid and is to be covered by the closure to the exterior of the burner, and when the fire outlet is to be not covered by the lid and is to be open to the exterior of the burner, the lid being displaced to the first position, when a user uses the burner for filling liquid fuel into the fuel inlet, and the lid being displaced to the second position, when a user does not use the burner, and the lid being displaced to the third position, when a user uses the burner for burning liquid fuel in the burner.

The relatively high temperature may be between 30 degrees Celsius and 80 degrees Celsius, and the relatively low temperature may be below 80 degrees Celsius, preferably below 50 degrees Celsius.

DETAILED DESCRIPTION

Figure 1:
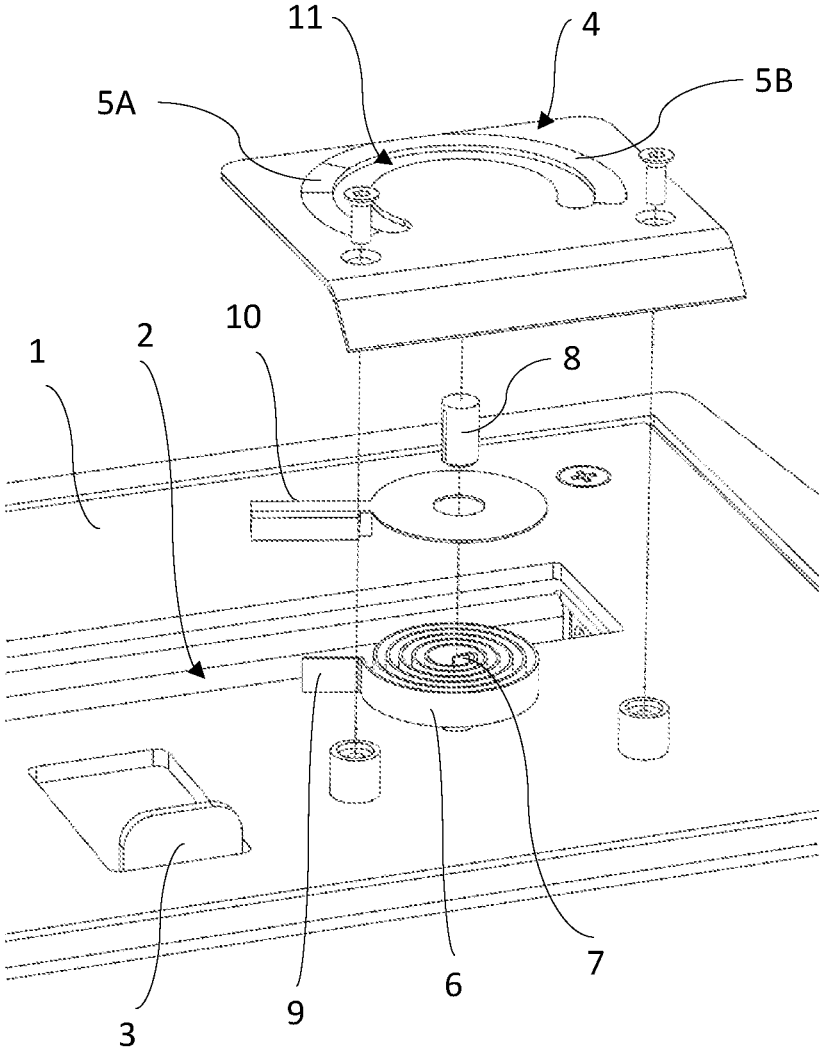
FIG. 1 shows, in exploded view, one embodiment of a stopping means, embodied as a gauge, according to the invention to be mounted on a burner for liquid fuel.

FIG. 1 shows an embodiment of parts of a burner with a stopping means in the embodiment of a gauge, which in FIG. 1 is shown in an exploded view.

All figures show various parts of an embodiment of a burner. The burner, apart from burning liquid fuel, is intended for allowing and preventing access to a fire outlet of the burner. The burner has a top cover 1 and a fire outlet 2 for fire from burning liquid fuel to leave the burner. The fire outlet 2 is provided in the top cover 1 of the burner.

A container (not shown) of the burner, for storing liquid fuel in the burner before the liquid fuel is burnt, is provided underneath the top cover 1. The fire outlet 2 is positioned above a position inside the burner where the container is provided. Liquid fuel is passed from the container underneath the fire outlet 2 and to the fire outlet 2 for liquid fuel to be burnt and so that fire is visible in a room, where the burner is situated or in a chimney. In the embodiment shown, liquid fuel is intended for being filled into the container by filling liquid fuel into the fire outlet 2. However, liquid fuel must not be filled into the fire outlet 2 when fire is burning, and liquid fuel must not be filled into the fire outlet 2 when the burner is too hot to safely fill liquid fuel into the fire outlet 2.

In the embodiment shown, a burner lid (not shown) is provided underneath the top cover 1. The burner lid is displaceable between an open position, where the burner lid is fully covered by the top cover 1, as shown, thereby allowing access to the fire outlet 2, and a closed position preventing access to the fire outlet 2. In the embodiment shown, the burner lid is operated manually by pushing a slide-button 3 forwards, as not depicted in FIG. 1, for preventing access to the fire outlet 2, or by pulling the slide-button rearwards 3, as depicted in FIG. 1, for allowing access to the fire outlet 2.

Figure 2:
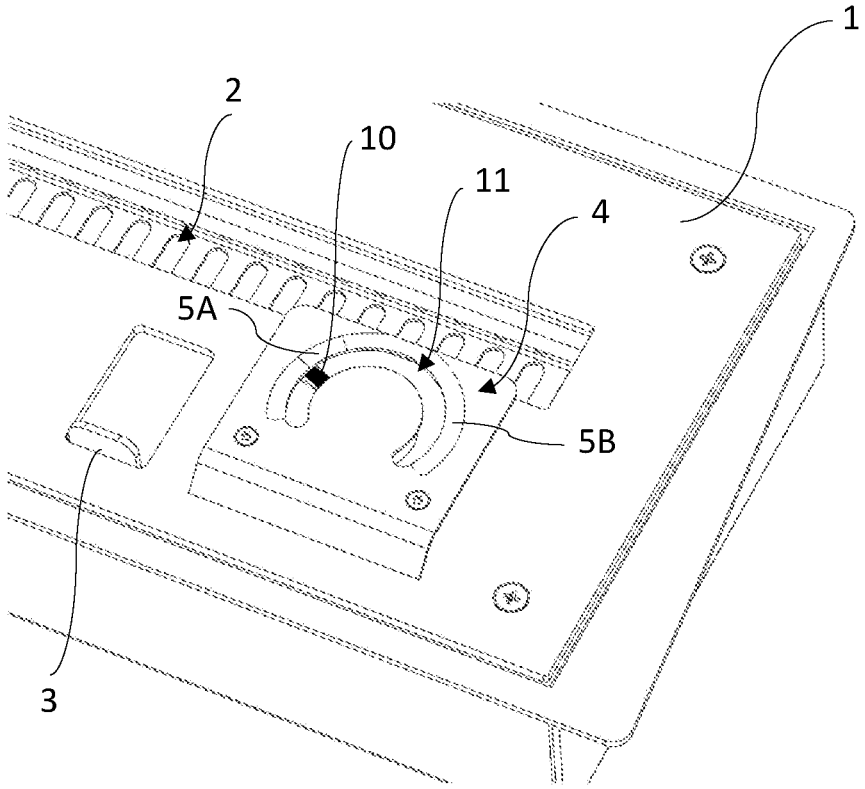
FIG. 2 shows, in assembled view, the one embodiment of the stopping means according to the invention mounted on a burner for liquid fuel, with an indicator in one position.
Figure 3:
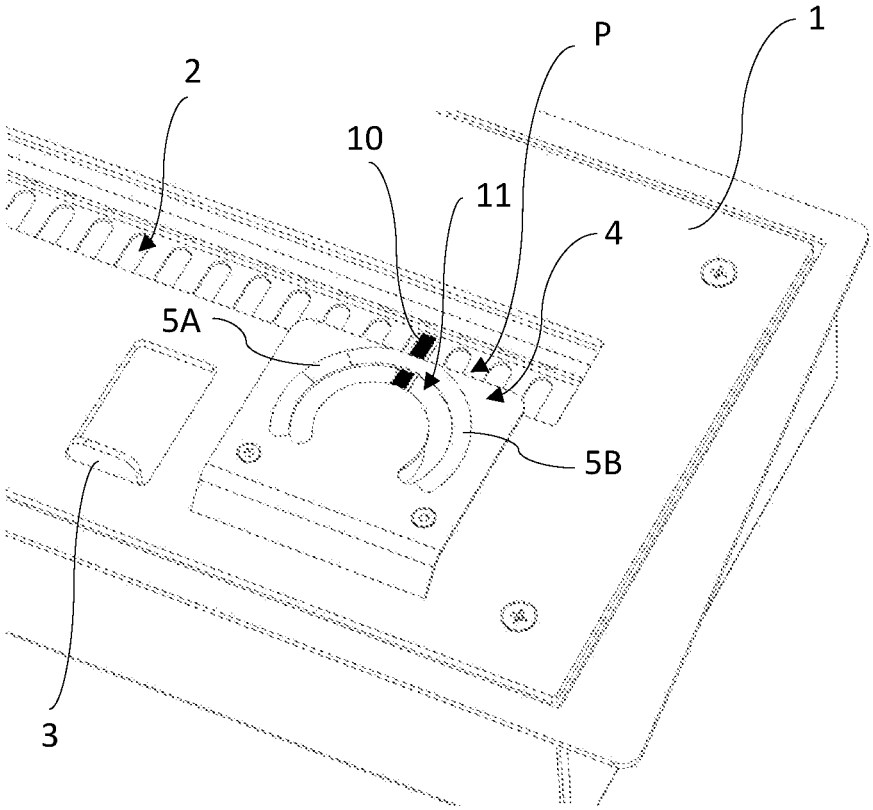
FIG. 3 shows, in assembled view, the one embodiment of the stopping means according to the invention mounted on a burner for liquid fuel, with an indicator in another position.

FIG. 2 and FIG. 3 also show the gauge. The gauge is capable of indicating the temperature of a specific selected area of the burner, where the gauge is mounted. In FIG. 1, the gauge is shown in an exploded view, in FIG. 2 and FIG. 3 in an assembled view.

The gauge has a dial 4 divided into a first section 5A, possibly coloured green or having other visual indication, extending along one selected circumference of the dial 6, and a second section 5B, possibly coloured red or other visual indication, extending along another selected circumference of the dial 6, so that a distinct visual difference is established between the first section 5A and the second section 5B.

Alternatively, the gauge may be divided into more sections where colouring or other visual indication gradually changes, as example, from green, to yellow, to orange, to red, or from one number to subsequent other increasing numbers indicating a temperature level, that is, a gauge with a step-wise visual difference along the dial.

The gauge comprises an actuator 6 changing shape depending on the temperature of the actuator 6. In the embodiment shown, the actuator 6 is a spiral coil made by a bimetal material. The spiral coil 6 has an inner end 7 attached to a hold 8 fixed to the burner and an extension 9 constituting an outer free end of the bimetal spiral coil. The extension 9 is capable of displacing clockwise and counter-clockwise. The extension 9 is directed radially outwards in relation to a rotational extension of the spiral coil 6.

An indicator 10 is mounted on the extension 9 of the bimetal spiral coil 6. The indicator is visible through a slot 11 (see also FIG. 2 and FIG. 3) in the dial 4. The indicator 10 is intended for changing position together with the extension 9 of the bimetal spiral coil 6 along the dial 4, when the extension 9 changes position. The indicator 10 changing position occurs, when the geometrical shape of the bimetal spiral coil 6 changes.

Change of the geometrical shape of the bimetal spiral coil 6 occurs when the bimetal spiral coil 6 contracts clockwise, as depicted in the figures, or when the bimetal spiral coil 6 expands counter-clockwise, as depicted in the figures, depending on the temperature of the bimetal spiral coil 6. The position of the indicator shows to the user whether the burner top 1 is cold enough, or is too hot, for safely filling liquid fuel into the burner.

The gauge is showing the user that it is safe to fill liquid fuel into the burner, when the indicator 10 is within the first section 5A, and that it is unsafe to fill liquid fuel into the burner, when the indicator is within the second section 5B. A colour green or other visual indication of the first section 5A of the dial 4, together with the indicator 10 being within the first section 5A of the dial 4, showing the user that the temperature of the burner top 1 is relatively low compared to a colour red or other visual indication of the second section 5B of the dial 4, together with the indicator 10 being within the second section 5A of the dial 4, showing the user that the temperature is relatively high, at least temperature too high to safely fill liquid fuel into the burner.

In the embodiment shown, the gauge with the actuator 6, that is, the bimetal spiral coil 6, is positioned on the burner top 1 in an immediate vicinity of the fire outlet 2.

In an alternative embodiment, the actuator could be a pneumatic or hydraulic actuator with a piston and a piston rod extending into a closed cylinder, where a fluid inside the closed cylinder expands when the temperature increases, and contracts when the temperature decreases. When the fluid expands, the piston displaces the indicator towards a second position within the second section of a dial, and when the fluid compresses, the piston displaces the indicator towards a first position within the first section of a dial.

Other types of actuators, operating mechanically and not operated electrically and manually, and capable of displacing an indicator, more or less, when the temperature increases or decreases, may be envisaged by the person skilled in the art.

In the embodiment shown in FIG. 2 and FIG. 3, part of the second section 5B of the dial, that is, the section of the dial 6 showing the user that it is unsafe to fill liquid fuel into the burner because the burner is too hot, extends along a perimeter P of the gauge and extends in immediate vicinity of, and above part of, the fire outlet 2.

FIG. 3, in the embodiment shown, shows that the indicator 10 has a length resulting in the indicator 10, when the indicator 10 is situated in part of the second section 5B, extending outside the perimeter of the gauge, into an immediate exterior of the gauge, above the fire outlet 2. The indicator 10 thereby covers part of the fire outlet 2, preventing a funnel to be positioned in the fire outlet 2 at a position, where the indicator 10 covers the fire outlet 2. Especially when using a funnel, as shown in FIG. 12 and FIG. 13, and having an oblong gutter-like shape of the funnel to be positioned in the fire outlet 2, the indictor 10 covering part of the fire outlet 2 thereby prevents using this embodiment of a funnel for filling liquid fuel into the burner.

Figure 12:
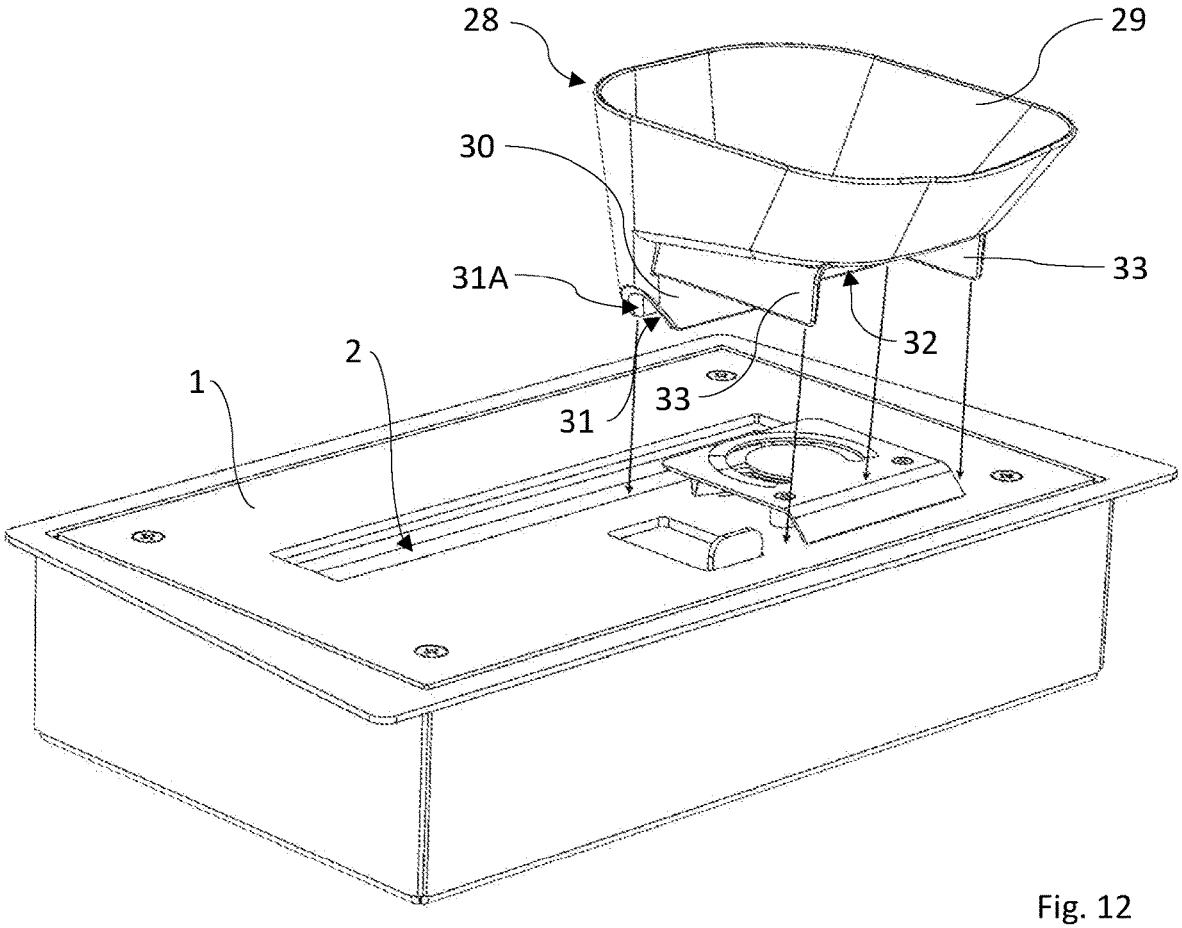
FIG. 12 is a perspective view of funnel according to the invention for filling liquid fuel through a fire outlet of a burner for liquid fuel.
Figure 13:
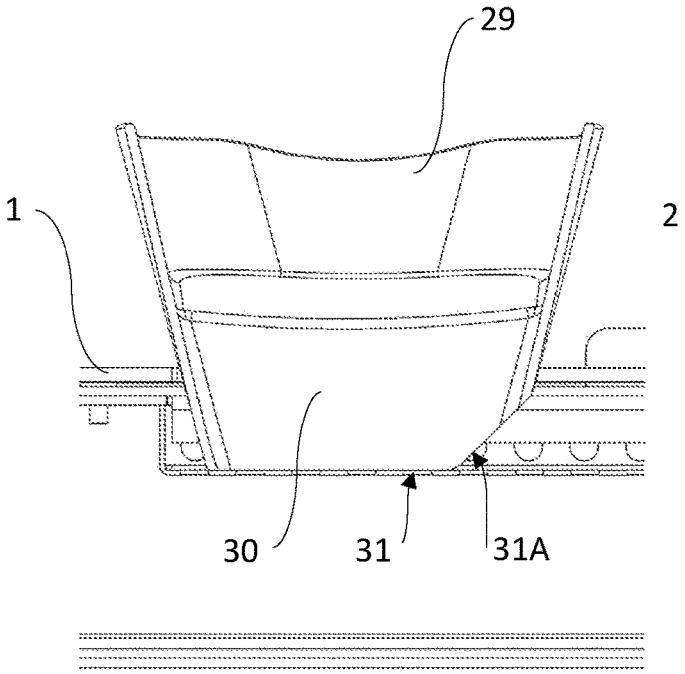
FIG. 13 is a detailed view of the funnel according to the invention for filling liquid fuel through a fire outlet of a burner for liquid fuel.

Accordingly, the gauge with the indicator 10 positioned in part of the second section 5B not only shows a user that it is unsafe to fill liquid fuel in to the burner, but at the same time also prevents a user from using a funnel in the embodiment shown in FIG. 12 and FIG. 13 for filling liquid fuel into the burner, because the indicator 10 covers part of the fire outlet 2, resulting in an increased safety towards filling liquid fuel into the burner, when the temperature of the burner top 1 is relatively high.

In the embodiment of the indicator shown, the indicator is shaped like a non-pointed needle. In an alternative embodiment, the indicator is shaped as a partial disc, where the partial disc is capable of extending along an outer perimeter of the bimetal spiral coil, from a leading edge of the partial disc and counter-clockwise to a trailing edge of the partial disc. An indicator shaped as a partial disc, the leading edge indicating the temperature, results in the indicator blocking the fire outlet, even when the leading edge is displaced at an end position of the second section 5B of the dial 4.

Figure 4:
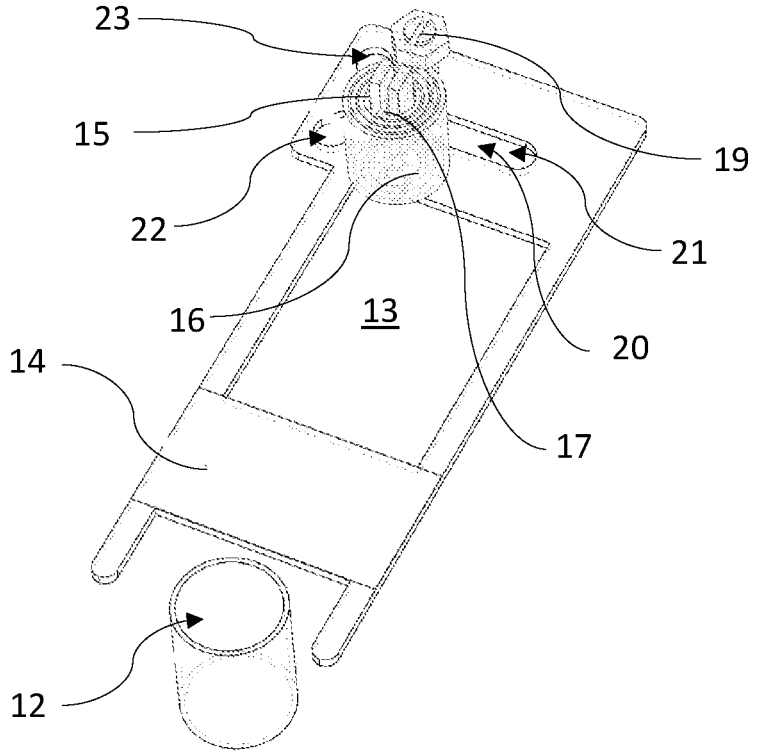
FIG. 4 is a view of another embodiment of a stopping means, embodied as a closure, according to the invention with the closure in an open state.
Figure 5:
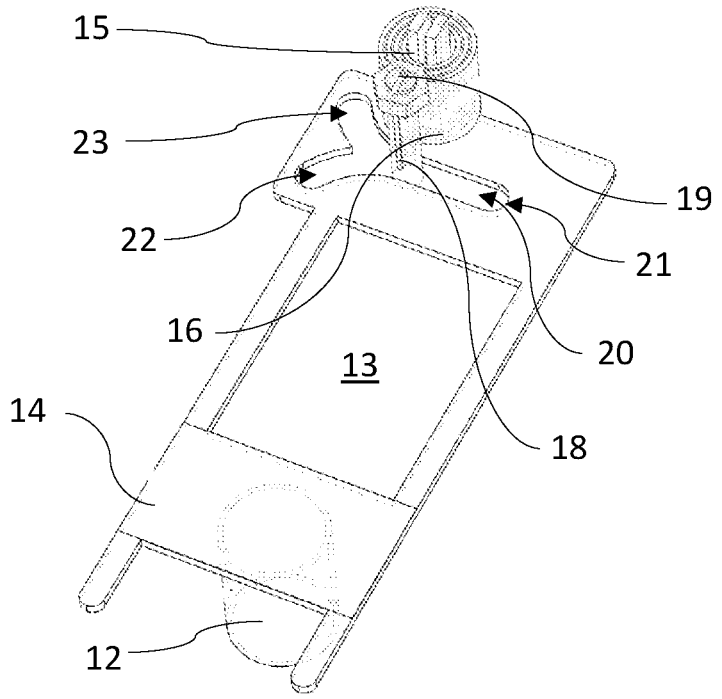
FIG. 5 is a view of the other embodiment of the stopping means according to the invention with the closure in a covered by the closure state.

FIG. 4 and FIG. 5 show parts of a burner with a stopping means in an embodiment of a closure 14. The closure 14 is intended for allowing and preventing access to a fuel inlet 12 of a burner for filling liquid fuel into a container of the burner. The burner has a top cover 1 (see FIG. 6-11) of a burner. The burner also has a fire outlet 2 (see FIG. 6-11) for fire from burning liquid fuel to leave the burner. The fuel inlet 12 is separate from the fire outlet 2 and the fuel inlet 12 is positioned in distance from the fire outlet 2 (see FIG. 6-11).

A container (not shown) of the burner, for storing liquid fuel in the burner before the liquid fuel is burnt, is provided underneath the top cover 1. The fire outlet 2 is positioned above a position inside the burner where the container is provided. Liquid fuel is passed from the container underneath the fire outlet 2 and to the fire outlet 2 for liquid fuel to be burnt and so that fire is visible in a room, where the burner is situated or in a chimney. In the embodiment shown, liquid fuel is intended for being filled into the container by filling liquid fuel into the fuel inlet 12. However, liquid fuel must not be filled into the fuel inlet 12 when the burner is too hot to safely fill liquid fuel into the fuel inlet 12.

In the embodiment shown, the closure 14 has the shape of a plate with a void space 13 in the middle. The void space 13 is provided so that fire from liquid fuel being burnt in the fire burner can escape part of the fire outlet 2 possibly covered by the closure 14. In FIG. 4, the closure 14 is in a first position, allowing access to the fuel inlet 12 for filling liquid fuel into the fuel inlet 12 and into the container of the burner. In FIG. 12, the closure 14 is in a second position, preventing access to the fuel inlet 12 and preventing filling liquid fuel into the fuel inlet 12. In the embodiment shown, the closure 14, both when in the first position and when in the second position, maintains the fire outlet 2 open.

In an alternative embodiment, the closure 14 has another shape than the one shown in FIG. 4 and FIG. 5. In the alternative embodiment, the closure 14 is a plate having a width extending along the entire width of the fire outlet 2. When the closure 14 is in the first position, the closure 14 allows access to the fuel inlet 12. However, the closure 14, when in the second position, prevents access to the fuel inlet 12.

The closure 14 is operated by an actuator 16. In the embodiment shown, the actuator 16 is a spiral coil 16 made by a bi-metal material. The spiral coil 16 has an inner end 17 (see FIG. 4) attached to a hold 15. The hold 15 is fixed in relation to the top cover 1. The actuator 16 has an outer end 18 (see FIG. 5) attached to the closure 14 via a mechanical connection 19. The mechanical connection 19 is displaceable in relation to the top cover 1. In the embodiment shown, the mechanical connection 19 is a stop pin.

In FIG. 4, the outer end 18 of the spiral coil 16 and the stop pin 19 is in a first end position, which results in a position of the closure 14, where the fuel inlet 12 is not covered by the closure 14, and where the fuel inlet 12 is fully open to the exterior of the burner, allowing liquid fuel to be filled into the fuel inlet 12.

In FIG. 5, the outer end 18 of the spiral coil 16 and the stop pin 19 is in a second end position, which results in a position of the closure 14, where the fuel inlet 12 is covered by the closure 14, and where the fuel inlet 12 is fully closed to the exterior of the burner, preventing liquid fuel to be filled into the fuel inlet 12.

In the embodiment shown, the closure 14 has a track 20 with one end 21 and two opposite curved ends 22,23. The track 20 of the closure plate is a fail-safe solution, if the spiral coil 16 possibly displaces past the first end position or past the second end position, because of the spiral coil 16 being mechanically deformed because of damage to the spiral coil 16, or because of the spiral coil 16 being thermally deformed due to being over-heated.

If the outer end 18 of the spiral coil 16 and the stop pin 19 extend past the first end position, the stop pin 19 pass further along the one curved end 22 of the track 20. The stop pin 19 passing towards the one curved end 22 of the track 20 results in the closure 14 staying in place, as if the stop pin 19 were in the first end position of the stop pin 19.

The stop pin 19 passing along the one curved end 22 of the track 20 prevents the closure plate 14 from being displaced downwards (as viewed in the figure), even though the outer end 18 of the spiral coil 16 and the stop pin 19 extend past the first end position.

If the outer end 18 of the spiral coil 16 and the stop pin 19 extend past the second end position, the stop pin 19 pass further along the other curved end 23 of the track 20. The stop pin 19 passing towards the other curved end 23 of the track 20 results in the closure 14 staying in place, as if the stop pin 19 were in the second end position of the stop pin 19.

The stop pin 19 passing along the other curved end 22 of the track 20 prevents the closure plate 14 from being displaced upwards (as viewed in the figure), even though the outer end 18 of the spiral coil 16 and the stop pin 19 extend past the second end position.

FIG. 6-11 show the stop pin 19 extending into a groove 24 in a top cover 1 of the burner (not shown). The top cover 1 constitutes a top surface of the burner.

The groove 24 extends circumferentially along the circumference of the spiral coil 16. The groove 24 has two opposite ends 25,26. The stop pin 19 is capable of sliding along the groove 24 between each of the two opposite ends 25,26. In FIG. 1, the stop pin 19 is positioned at one end 25 of the groove 24, and in FIG. 12 the stop pin 19 is positioned at the other opposite end 26 of the groove 24. The stop pin 19 is capable of being displaced between the one end 25 and the other end 26 of the groove 24, and vice versa.

Displacement of the stop pin 19 is provided by the spiral coil 16. When the spiral coil 16 is in the first end position (see also FIG. 4), that is the spiral coil 16 being in an intended innermost coiled state, the stop pin 19 is positioned at the one end 25 of the groove 24. When the spiral coil 16 is the second end position (see also FIG. 5), that is the spiral coil 16 being in an intended outermost coiled state, the stop pin 19 is positioned at the other opposite end 26 of the groove 24.

The spiral coil 16 is in the innermost coiled state, when the spiral coil 16 has one relative low temperature, and the spiral coil 16 is in the outermost coiled state, when the spiral coil 16 has a relative high temperature, compared to the relatively low temperature.

Change in temperature of the spiral coil 16 is taking place, when flames from burning liquid fuel leave the fire outlet 2, and the top cover 1 thereby is heated. Heating of the top cover 1 results in heating of the spiral coil 16 to a subsequent high temperature, that is, the relatively high temperature, compared to an initial, non-heated temperature, that is, the relatively low temperature. During heating of the top cover 1 and of the spiral coil 16, by the fire from burning liquid fuel, the bimetal materiel of the spiral coil 16 results 5 in the spiral coil 16 spiralling outwards, in the figures spiralling clock-wise.

The fuel inlet 12 must be covered by the closure 14, when the temperature of the actuator 16, that is, the spiral coil 16, is above a selected threshold temperature.

FIG. 5-11 show an additional lid 27 extending below the top cover 1 of the burner. The additional lid 27 is intended for being operated manually by a user of the burner. The additional lid 27 is capable of displacing along the top cover 1, upwards and downwards as viewed in the figures, between a first position of the lid 27 (see FIG. 6 and FIG. 9), in which first position the lid 27 allows access to the fuel inlet 12 and prevents access through a fire outlet 2 for fire from burning liquid fuel, a second position of the lid 27 (see FIG. 7 and FIG. 10), in which second position the lid 27 prevents access to the fuel inlet 12 and also prevents access through the fire outlet for fire from burning liquid fuel, and a third position of the lid 27 (see FIG. 8 and FIG. 11), in which third position the lid 27 prevents access to the fuel inlet 12 and allows access through the fire outlet for fire 20 from burning liquid fuel.

Figure 6:
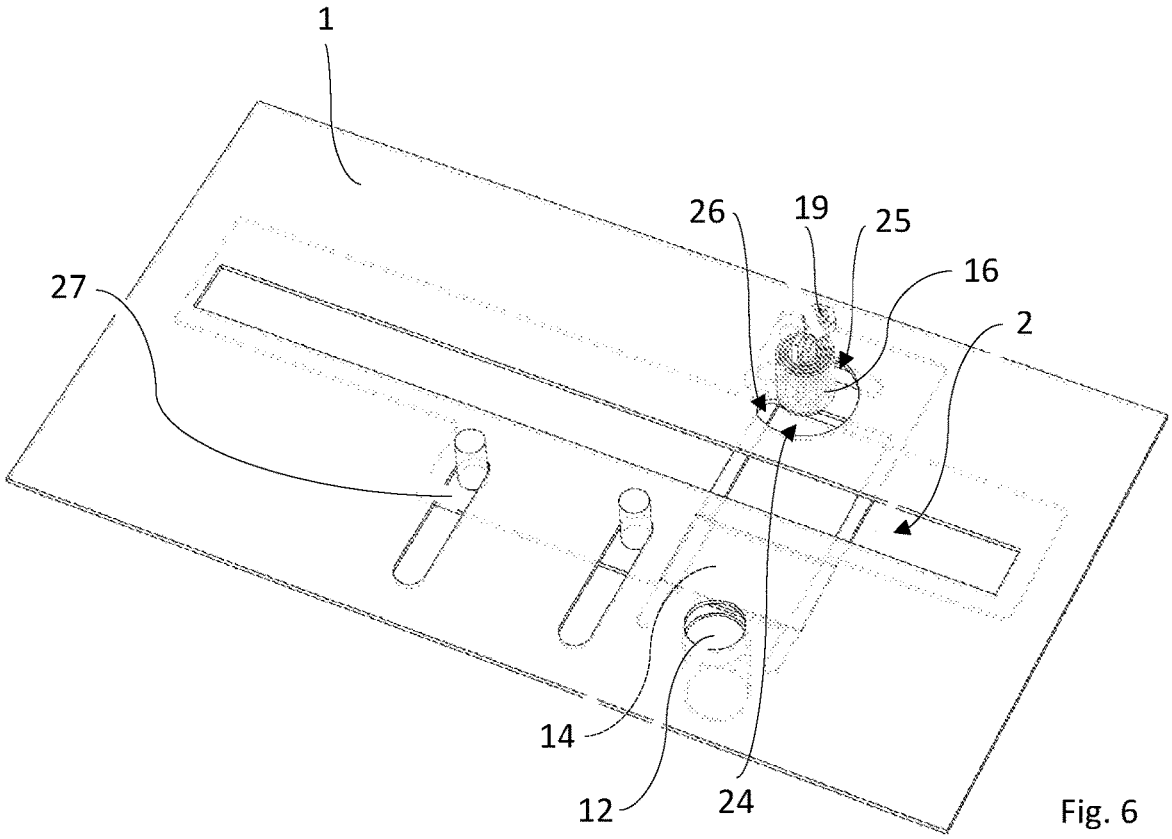
FIG. 6 is a view of a still other embodiment of a stopping means according to the invention with a closure in an open state and an additional lid in a first state.

FIG. 6 shows the closure 14 in the first position, the closure 14 allowing access to the fuel inlet 12, and shows the lid 27 in the first position, the lid 27 also allowing access to the fuel inlet 12. Therefore, access to the fuel inlet 12 is allowed both by the automatic closure 14 and by the lid 27 having been displaced to the first position of the lid 27, manually by a user. The fire outlet 14 is covered by the closure by the lid 27 when in the first position.

Figure 7:
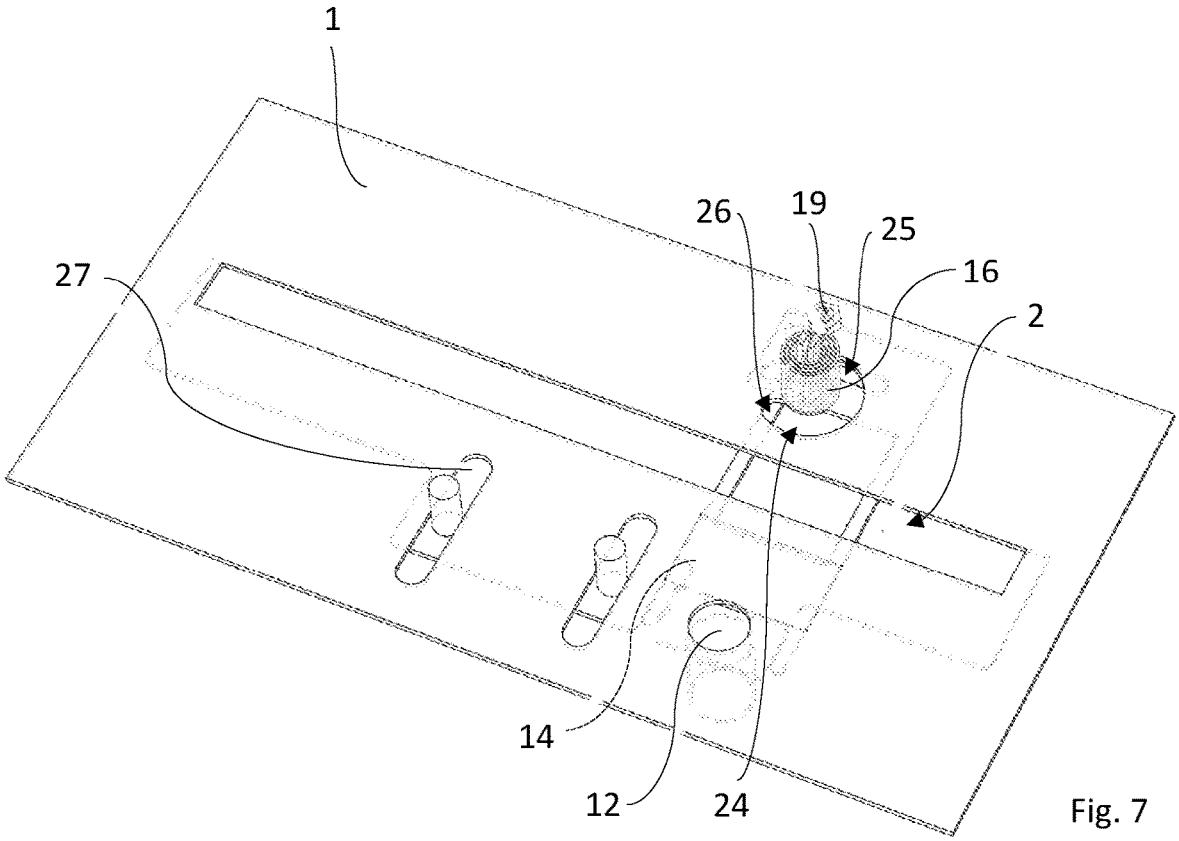
FIG. 7 is a view of the still other embodiment of the stopping means according to the invention with the closure in an open state and the additional lid in a second state.

FIG. 7 shows the closure 14 in the first position, the closure 14 allowing access to the fuel inlet 12, and shows the lid 27 in the second position, the id 27 preventing access to the fuel inlet 12. Therefore, access to the fuel inlet 12 is prevented, not by the automatic closure 14, but by the lid 27 having been displaced to the second position of the lid 27, manually by a user. The fire outlet 14 is covered by the closure by the lid 27 when in the second position.

Figure 8:
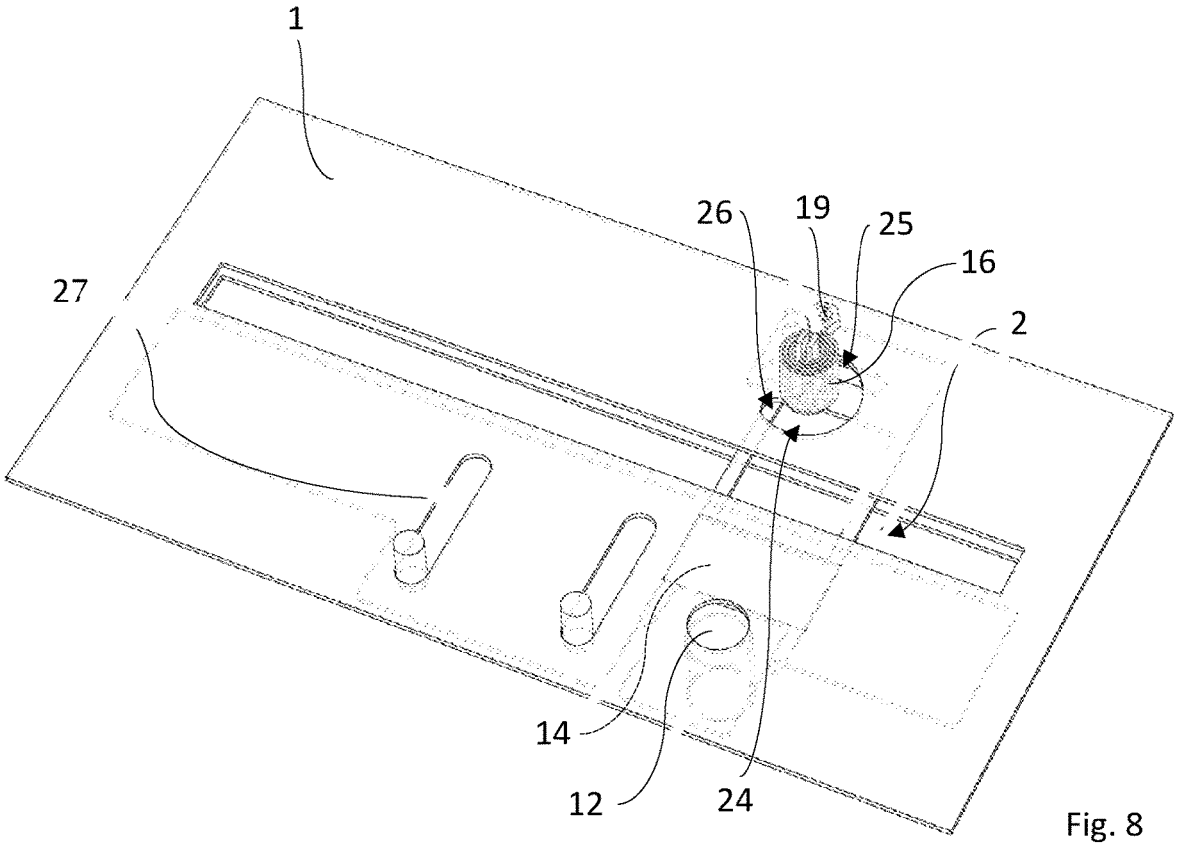
FIG. 8 is a view of the still other embodiment of the stopping means according to the invention with the closure in the open state and the additional lid in a third state.

FIG. 8 shows the closure 14 in the first position, the closure 14 allowing access to the fuel inlet 12, and shows the id 27 in the third position, the lid 27 preventing access to the fuel inlet 12. Therefore, access to the fuel inlet 12 is prevented, not by the automatic closure 14, but by the lid 27 having been displaced to the third position of the lid 27, manually by a user. The fire outlet 14 is open by the lid 27 when in the third position.

Figure 9:
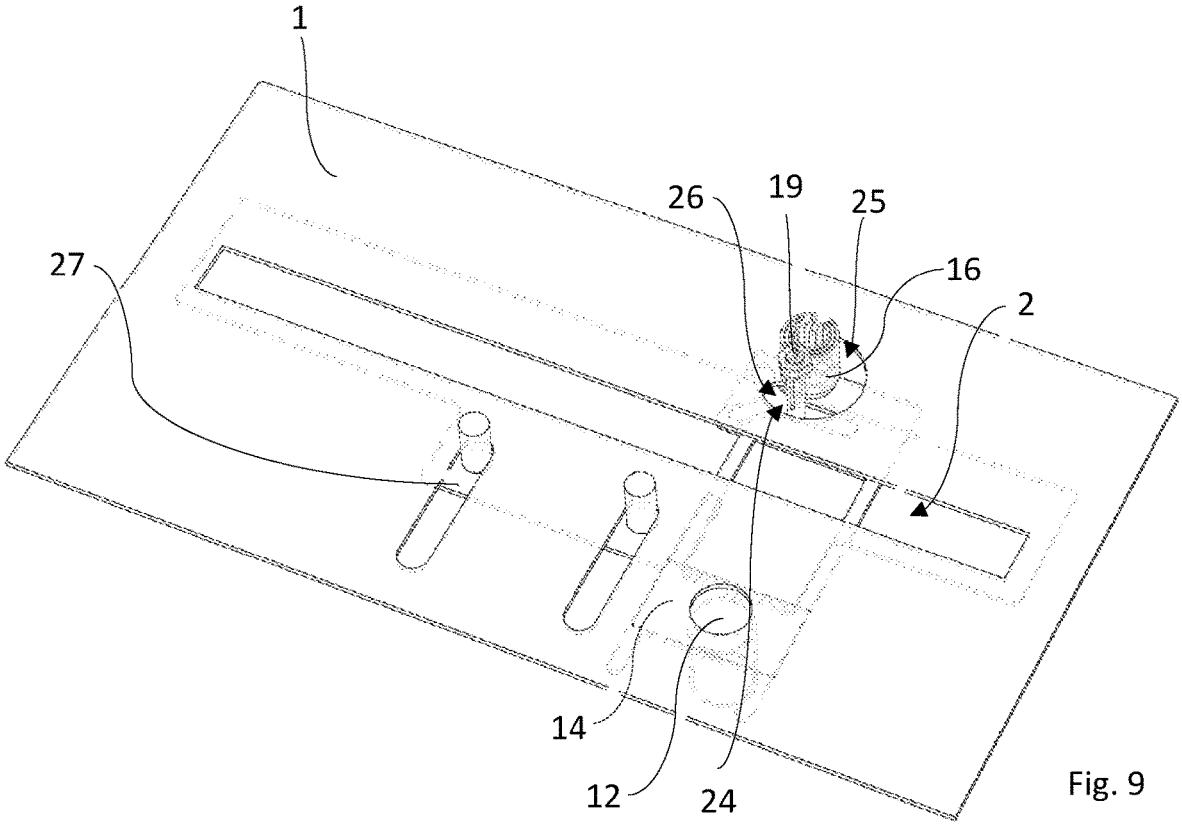
FIG. 9 is a view of the still other embodiment of the stopping means according to the invention with the closure in a closed state and the additional lid in the third state.

FIG. 9 shows the closure 14 in the second position, the closure 14 preventing access to the fuel inlet 12, and shows the lid 27 in the first position, the lid 27 also allowing access to the fuel inlet 12. Therefore, access to the fuel inlet 12 is prevented by the automatic closure 14, but not by the lid 27 having been displaced to the first position of the lid 27, manually by a user. The fire outlet 14 is covered by the closure by the when in the first position.

Figure 10:
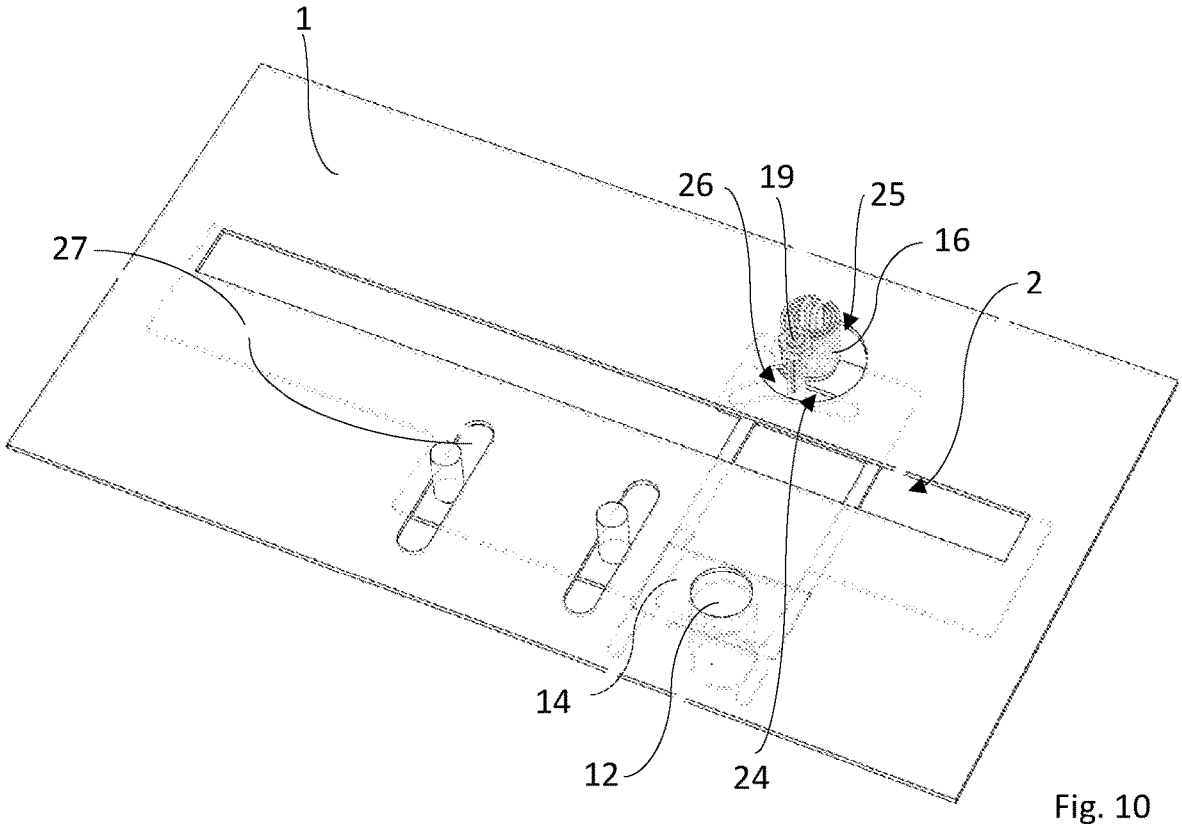
FIG. 10 is a view of the still other embodiment of the stopping means according to the invention with the closure in a closed state and the additional lid in the second state.

FIG. 10 shows the closure 14 in the second position, the closure 14 preventing access to the fuel inlet 12, and shows the lid 27 in the second position, the lid 27 also preventing access to the fuel inlet 12. Therefore, access to the fuel inlet 12 is prevented, both by the automatic closure 14 and by the lid 27 having been displaced to the second position of the lid 27, manually by a user. The fire outlet 14 is covered by the closure by the lid 27 when in the second position.

Figure 11:
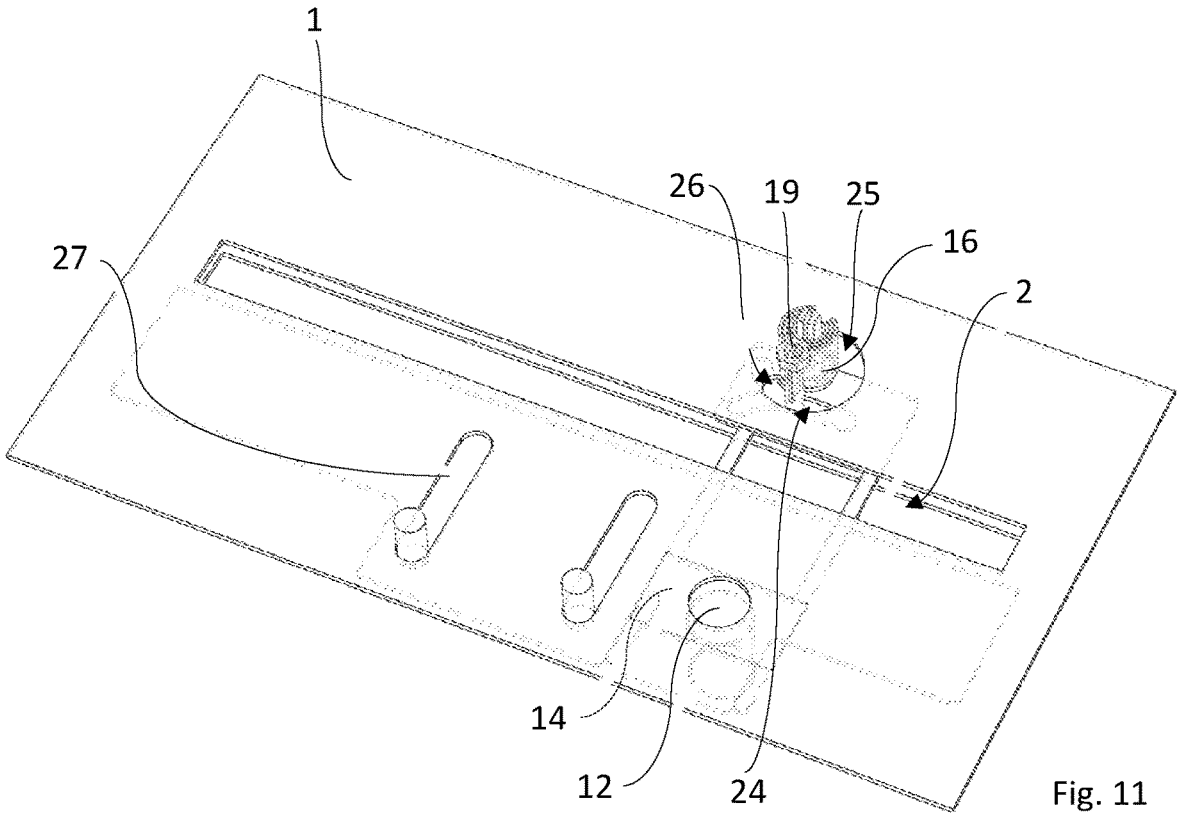
FIG. 11 is a view of the still other embodiment of the stopping means according to the invention with the closure in a closed state and the additional lid in a first state.

FIG. 11 shows the closure 14 in the second position, the closure 14 preventing access to the fuel inlet 12, and shows the lid 27 in the third position, the lid 27 also preventing access to the fuel inlet 12. Therefore, access to the fuel inlet 12 is prevented both by the automatic closure 14 and by the lid 27 having been displaced to the third position of the lid 27, manually by a user. The fire outlet 14 is open by the lid 27 when in the third position.

The additional lid 27 has a length and a width closing the fire outlet 2, when the lid 27 is in the first position and in the second as shown in FIG. 5, FIG. 6, FIG. 9 and FIG. 10, in which first position and second positions of the lid 27, the lid 27 prevents fire from burning liquid fuel to leave the burner through the fire outlet 2. Preferably, possible fire from burning liquid fuel is extinguished, when the lid 27 is in the first position and in the second position.

Marking may be provided both on the closure 14 and on the lid 27, or possibly only on the closure 14 or only on the lid 27, to show a user, when the fuel inlet 12 is closed and/or when the fuel inlet 12 is open. Marking may also be provided on the lid 27 to show a user when the fire outlet 2 is closed and/or when the fire outlet 2 is open.

Filling liquid fuel into the fire outlet, using the fire outlet as the fuel inlet is preferably performed by using a funnel. In the following, an embodiment of a funnel for safely filling liquid fuel into the fire outlet, especially in a burner with stopping means in the embodiment of a gauge, as shown in FIG. 1, FIG. 2 and FIG. 3, is described in detail.

Fire outlet of burners for burning liquid fuel is most often provided with a wicking material for passing liquid fuel from the container of the burner to the fire outlet. If liquid fuel is filled into the container via other openings than through the fire outlet, some time elapses before the wicking material is sufficiently wedded by liquid fuel to be ignited.

By filling the liquid fuel into the fire outlet, the wicking material is instantly wedded with liquid fuel. However, for having a satisfactory fire burning, the wicking material along the entire longitudinal extension of the fire outlet must be wedded. If liquid fuel is filled into the fire outlet in one position only, wedding of the wicking material will take some time.

A funnel design having an enlarged opening directed towards the remainder of the longitudinal extension of the fire outlet results in liquid fuel, filled into the fire outlet through the funnel, being passed to the entire fire outlet, without having to displace the funnel. This is different to a traditional funnel only passing liquid fuel downwards through the nozzle-like shape of a traditional funnel, and the traditional funnel having to be manually displaced along the fire outlet to fill the entire fire outlet with liquid fuel.

FIG. 12 and FIG. 13 show a funnel 28 provided for filling liquid fuel into the burner via the fire outlet 2. Alternatively, liquid fuel may be filled into the burner directly, without use of a funnel, into the fire outlet 2 or directly into a separate fuel inlet, if such is provided.

FIG. 12 shows in perspective a preferred embodiment of a funnel 28, shaped differently than a traditional funnel. A traditional funnel is shaped with a primary part with a frustoconical shape and a secondary part with a nozzle-like shape, the nozzle-like shape serving as an outlet from the frusto-conical shaped part of the funnel.

The preferred funnel 28 for filling liquid fuel into the burner has a tray-like shape 29 into which liquid fuel is to be filled into the funnel 28, and an oblong gutter-like shape 30 out of which the liquid fuel leaves the funnel 28. The oblong gutter-like shape 30 extends along one bottom side of the tray-like shape 29. An outlet 21 is provided in the oblong gutter-like shape 30. The outlet 21 is provided in the oblong gutter-like shape 30 so that liquid fuel filled into the funnel 28 leaves the funnel 28 through the outlet 21 both downwards and sideways of the oblong gutter-like shape 30, as depicted in FIG. 13.

The funnel 28 has a substantially flat bottom 32, apart from that side of the funnel, where the oblong gutter-like shape 30 is provided. The funnel 28 also has support brackets 33 extending from the bottom 32 of the funnel. The support brackets 33 are intended for being placed on the burner top 1, providing a stable and safe abutment of the funnel 28 on the burner, when liquid fuel is to be filled into the burner. When the support brackets 33 of the funnel 28 are placed on the burner top 1, the oblong gutterlike shape 30 of the funnel 28 extends laterally, horizontally along a part of a longitudinal extension of the fire outlet 2 (see FIG. 13).

FIG. 13 shows the oblong gutter-like shape 30 of the funnel 28 placed in the fire outlet 2.

The outlet 21 of the oblong gutter-like shape 30 of the funnel 28 is directed both downwards and towards the remainder of the longitudinal extension of the fire outlet 2. The outlet 21 has an enlarged opening 31A towards the right side as depicted in FIG. 29, which is towards the remainder of the longitudinal extension of the fire outlet 2.

Thereby, liquid fuel filled into the tray-like shape 29 of the funnel 28 and passed to the fire outlet 2 via the oblong gutter-like shape 30 of the funnel 28 is allowed to better being passed towards the right side, which is towards the remainder of the longitudinal extension of the fire outlet 2, when the funnel 28 is placed on the burner top 1.

In the embodiment shown in the figures, the gauge is positioned to the right in relation to the longitudinal extension of the fire outlet 2. In alternative embodiments, the gauge may be positioned in the centre in relation to the longitudinal extension of the fire outlet 2, or to the left in relation to the longitudinal extension of the fire outlet 2.

If the gauge is positioned in the centre in relation to the longitudinal extension of the fire outlet 2, the oblong gutter-like shape 31 of the funnel will preferably have enlarged openings 31A at both sides of the oblong gutter-like shape 31, thereby allowing liquid fuel to be better passed not only to the centre, but also to each side, of the fire outlet 2.

If the gauge is positioned to the left in relation to the longitudinal extension of the fire outlet 2, the oblong gutter-like shape 31 of the funnel will preferably have an enlarged opening 31A at the right side, as depicted in FIG. 28 and FIG. 29, of the oblong gutterlike shape 30 for better passing liquid fuel to the left side of the fire outlet 2.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A burner for burning liquid fuel, the burner comprising a container for storing the liquid fuel, an opening allowing filling of liquid fuel through the opening and into the container, and a fire outlet for fire from burning liquid fuel to leave the container of the burner, the burner also comprising a stopping means for preventing filling of liquid fuel through the opening and into the container of the burner, where the burner comprises an actuator for displacing the stopping means between a first position and a second position, and vice versa, and where the actuator is positioned in a part of the burner being heated by fire from burning liquid fuel, where the actuator is provided in a position, in relation to the fire outlet, resulting in the actuator changing temperature depending on a temperature of the burner within the vicinity of the opening for filling liquid fuel into the container of the burner, where change of the temperature of the actuator, because of change of temperature of the part of the burner being heated by fire from burning liquid fuel, results in change of a geometrical shape of the actuator, and the actuator and the stopping means being mutually connected for the actuator displacing the stopping means when a change of geometrical shape of the actuator occurs, where change of the geometrical shape of the actuator results in displacement of the stopping means, via the connection, between the first position and the second position, towards the first position or towards the second position, and where the stopping means is displaced towards the first position, when the temperature of the actuator is changed from a relatively high temperature to a relatively low temperature, and in which first position the stopping means is allowing liquid fuel to be filled into the container of the burner, and where the stopping means is displaced towards the second position, when the temperature of the actuator is changed from a relatively low temperature to a relatively high temperature, and in which second position the stopping means is not allowing liquid fuel being filled into the container of the burner.

2. The burner according to claim 1, where the actuator is a bimetal spiral coil, and where the stopping means is mounted on the spiral coil, and where the stopping means displaces together with the bimetal spiral coil, when the bimetal spiral coil is mounted on the burner and when the bimetal spiral coil is changing geometrical shape by expanding or contracting in dependence of a temperature change of the bimetal coil, due to a temperature change of the part of the burner.

3. The burner according to claim 1, where the actuator is a cylinder with a piston inserted into and displaceable along the cylinder, and where the stopping means is mounted on one of either the cylinder or the piston, and where the stopping means displaces together with the cylinder or the piston, when at least the cylinder is mounted on the burner and when the geometrical shape of the combined cylinder and piston is changing geometrical shape by expanding or contracting in dependence of a temperature change of a fluid in the cylinder, due to a temperature change of the part of the burner.

4. The burner according to claim 1, where the stopping means is a visual indication on a dial of a gauge, the gauge having the actuator mutually connected with the dial with the visual indication, the visual indication being divided between at least a first section of the dial and a second section of the dial, the first section of the dial indicating by the visual indication a relatively low temperature of the part of the burner, the second section indicating by the visual indication a relatively high temperature of the part of the burner, the gauge comprising an indicator capable of displacing between a first position within the first section and a second position within the second section, and the indicator being operated by the actuator for displacing the indicator between the one position and the other position, and vice versa, and where the actuator is positioned on part of the burner being heated by fire from burning liquid fuel where the indicator is displaced towards the first position, when the temperature of the actuator is changed from a relatively high temperature to a relatively low temperature, and in which position the indicator is visible within the one section of the dial indicating liquid fuel is safe to fill into the fire outlet, and where the indicator is displaced towards the second position, when the temperature of the actuator is changed from a relatively low temperature to a relatively high temperature, and in which second position the indicator is visible within the other section of the dial indicating liquid fuel is unsafe to fill into the fire outlet.

5. The burner according to claim 4, where the actuator is provided in immediate vicinity of the fire outlet, the immediate vicinity being a position, in relation to the fire outlet, resulting in the actuator changing temperature depending on a temperature of the burner within the vicinity of the fire outlet, and where the indicator, when being within the second section of the dial, extends outside part of a perimeter of the dial, said part of the perimeter outside the dial intended for being in immediate vicinity of the fire outlet, when the gauge is mounted on the burner, so that at least part of an immediate exterior of the dial is covered by the indicator and at least part of the fire outlet in immediate vicinity of the indicator is covered by the indicator.

6. The burner according to claim 1, where the opening for filling liquid fuel into the container of the burner is the fire outlet also functioning as the fuel inlet.

7. The burner according to claim 1, where the relatively high temperature is between 30 degrees Celsius and 80 degrees Celsius, and where the relatively low temperature is below 80 degrees Celsius.

8. The burner according to claim 1, where the stopping means is a closure for an opening of a fuel inlet for filling liquid fuel into a container of the burner, the fuel inlet being separate from the fire outlet, and the fuel inlet being positioned in distance from the fire outlet, the closure capable of being displaced between a first position where the opening of the separate fuel inlet is not covered by the closure, allowing liquid fuel to be filled into the opening and into the container of the burner, and a second position where the opening of the separate fuel inlet is covered by the closure, not allowing liquid fuel from being filled into the opening and into the container of the burner.

9. The burner according to claim 8, the burner comprising a lid capable of covering and not covering the fuel inlet and also capable of covering and not covering the fire outlet, thereby allowing or preventing liquid fuel to be filled into the fuel inlet and allowing or preventing fire from burning liquid fuel to leave the fire outlet of the burner, the lid being displaceable between a first position, where the fuel inlet is not covered by the lid and where the fire outlet is covered by the lid, allowing liquid fuel to be filled into the fuel inlet and preventing fire from burning liquid fuel to leave the fire outlet, and a second position, where the fuel inlet is covered by the lid and where the fire outlet is covered by the lid, preventing liquid fuel to be filled into the fuel inlet and preventing fire from burning liquid fuel to leave the fire outlet, and a third position, where fuel inlet is covered by the lid and where the fire outlet is not covered by the lid, preventing liquid fuel to be filled into the fuel inlet and allowing fire from burning liquid fuel to leave the fire outlet.

10. The burner according to claim 9, where the closure is capable of being in the first position, where the closure is not covering the fuel inlet, at the same time as the lid is in the second position or in the third position, where the lid is covering the fuel inlet, and where the closure is capable of being in the second position, where the closure is covering the fuel inlet, at the same time as the lid is in the first position, where the lid is not covering the fuel inlet.

11. The burner according to claim 8, where a switch mechanism is provided between the actuator and the closure, the switch mechanism capable of switching the closure, when operated by the actuator, from the first position, where the fuel inlet is fully open, to the second position, where the fuel inlet is fully covered by the closure, and vice versa, and the switch mechanism preventing the closure from being positioned in any intermediate positions, apart from when passing from the first position to the second position, and vice versa, the intermediate positions being between the first position and the second position, where the fuel inlet is either partly open or partly covered by the closure.

12. The burner according to claim 11, where the outer end of the bimetal spiral coil is provided with a stop extending into a groove in the top cover of the burner, said groove being a circumferential path for the stop, the groove extending along a distance and having two ends opposite each other, and where the stop is in abutment with one end of the groove, when the bimetal spiral coil is spiraled fully inwards, and where the stop is in abutment with another end of the groove, when the bimetal spiral coil is spiraled fully outwards, the stop thereby limiting spiralling of the bimetal spiral coil between a fully inwards spiralling and a fully outwards spiralling of the bimetal spiral coil, and thereby limiting displacement of the closure between the first position and the second position of the closure.

13. The burner according to claim 1 and intended for being filled with liquid fuel by use of a funnel for filling liquid fuel into a fire outlet of a burner for burning liquid fuel, the funnel having an inlet and an outlet for the liquid fuel, the outlet being provided in an oblong shape of the funnel, said oblong funnel outlet intended for extending horizontally along a longitudinal extension of a fire outlet of a burner when the funnel is placed on, or near, the burner and when liquid fuel is filled into the fire outlet of the burner via the funnel inlet and further via the funnel outlet in the oblong shape and into the longitudinal extension of the fire outlet, where the actuator is provided in immediate vicinity of the fire outlet, the immediate vicinity being a position, in relation to the fire outlet, resulting in the actuator changing temperature depending on a temperature of the burner within the vicinity of the fire outlet, and the first section of the dial indicating by the visual indication a relatively low temperature of the part of the burner, the second section indicating by the visual indication a relatively high temperature of the part of the burner, where the stopping means is a visual indication on a dial of a gauge, and the gauge comprising an indicator capable of displacing between a first position within the first section and a second position within the second section, where a perimeter of the gauge is in immediate vicinity of part of a longitudinal extension of the fire outlet, and where the indicator, when being within the second section of the dial, extends outside a perimeter of the gauge, so that at the indicator extends into an immediate exterior of the gauge, and where an oblong shape of the funnel is prevented from extending horizontally along part of a longitudinal extension of the fire outlet of the burner, when the indicator extends outside the perimeter of the gauge, so that at least part of the longitudinal extension of the fire outlet is covered by the indicator.

* * * * *